US007204519B2

(12) United States Patent
Kubo et al.

(10) Patent No.: US 7,204,519 B2
(45) Date of Patent: Apr. 17, 2007

(54) CONSTRUCTION MACHINE

(75) Inventors: Yoshiteru Kubo, Fukooka (JP); Kenichi Shimizu, Saitama (JP); Shinichi Senba, Saitama (JP); Kouhei Urase, Shiga (JP); Takaharu Nishimura, Shiga (JP)

(73) Assignees: Komatsu Ltd., Tokyo (JP); Komatsu Zenoah Co., Kawagoe, Saitama (JP); Hitachi Construction Machinery Co., Ltd., Tokyo (JP)

( * ) Notice: Subject to any disclaimer, the term of this patent is extended or adjusted under 35 U.S.C. 154(b) by 343 days.

(21) Appl. No.: 10/848,478

(22) Filed: May 19, 2004

(65) Prior Publication Data

US 2004/0244231 A1 Dec. 9, 2004

(30) Foreign Application Priority Data

May 20, 2003 (JP) ..... 2003-142604
Apr. 2, 2004 (JP) ..... 2004-110398

(51) Int. Cl.
*B62D 24/00* (2006.01)

(52) U.S. Cl. ..... 280/781; 180/9.1; 212/253; 296/204

(58) Field of Classification Search ..... 180/311, 180/9.1, 9.48, 6.12; 280/781; 212/181, 212/175, 253; 384/591–593; 414/687; 296/204; 37/379, 347

See application file for complete search history.

(56) References Cited

U.S. PATENT DOCUMENTS 4,231,699 A * 11/1980 Thompson ..... 414/687

FOREIGN PATENT DOCUMENTS

| | | |
|---|---|---|
| JP | 62-59577 | 4/1987 |
| JP | 3-49164 | 10/1991 |
| JP | 08-004053 | 1/1996 |
| JP | 2001-073409 | 3/2001 |
| JP | 2002-178960 | 6/2002 |
| RU | 2129194 C1 | 4/1999 |
| WO | WO 03/042022 A1 | 5/2003 |

* cited by examiner

*Primary Examiner*—Ruth Ilan
*Assistant Examiner*—Tiffany Webb
(74) *Attorney, Agent, or Firm*—Posz Law Group, PLC; R. Eugene Varndell, Jr.

(57) ABSTRACT

A construction machine where an operating load is transferred to a location having good rigidity, thereby ensuring the strength of a vehicle body and increasing the load-withstanding strength in relation to running loads. The frame of the lower traveling body of the construction machine comprising a hollow center frame having an upper plate with an attachment ring, a lower plate, and side plates that surrounding sides of the frame and that jut out from the attachment ring, and reinforcing ribs which connect the upper plate to the lower plate in the interior of the center frame beneath the attachment ring.

6 Claims, 10 Drawing Sheets

CONSTRUCTION MACHINE

BACKGROUND OF THE INVENTION

1. Field of the Invention

The present invention relates to a construction machine such as a hydraulic shovel, and more particularly to a frame constitution of a lower traveling body in a construction machine.

2. Description of the Related Art

A conventional hydraulic shovel 100 disclosed in "Crawler-type Vehicle" (Japanese Unexamined Patent Application Publication 2002-178960) comprises a traveling body 101 to enable movement, and a slewing body 102 which is mounted slewably above the traveling body 101, as shown in FIG. 9.

The slewing body 102 comprises a slewing frame 103, and the stewing frame 103 is provided with a body cover 104 accommodating a motor and the like, a cab 105 which defines the operating cabin, a counterweight 106, and so on, for example.

A working device 107 is provided elevatably at the front portion of the slewing body 102.

A truck frame 108 constituting the main body part of the traveling body 101 is constituted by a center frame 109 positioned in the center by means of steel plate welding or the like, and side frames 112 provided on both the left and right sides of the center frame 109 and extending to the front and rear, as shown in FIGS. 10A, 10B, and 10C.

Here, the center frame 109 is constituted by a central circular core 110, and leg parts 111 extending in a front/rear direction and a left/right direction from the outer periphery of the circular core 110 to form an overall H shape.

The leg parts 111 are formed as canning structures by an upper plate portion 111A, a lower plate portion 111B, side plate portions 111C which connect the plate portions 111A, 111B in a vertical direction, and so on.

112, 112 are left and right side frames provided on the tip end side of the leg portions 111 of the center frame 109 by welding. The side frames 112 are formed as frame bodies in a substantially reverse C shape extending in a front/rear direction.

Left and right mudguard covers 125, 125 are disposed respectively on the side frames 112, 112 of the truck frame 108.

The hydraulic shovel 100 described above travels over various types of ground surface by driving crawler belts 117 disposed on the traveling body 101 to rotate. As a result, earth, mud, and so on are churned up by the crawler belts 117.

Here, the mudguard covers 125, 125 provided in the vicinity of the crawler belts 117, 117 are constituted so as to extend in a horizontal direction, and hence the earth, mud, and so on that are churned up by the crawler belts 117 may accumulate on top of the mudguard covers 125, 125.

In this case, a worker must remove the accumulated earth, mud, and so on, and if the earth, mud, and so on are left to accumulate, they cause running resistance when the hydraulic shovel 100 is operated.

To improve earth removal, a constitution has been considered in which the frame of the lower traveling body is divided into a central box-shaped rotary case portion and the pair of truck frame portions, on which the crawler belts are provided, on the two sides of the rotary case portion, whereby the truck frames are connected to the rotary case portion via a pair of leg-shaped connecting members.

According to this constitution, the rotary case portion and the truck frame portions are connected via a pair of connecting members, and hence an open space is formed between the pair of connecting members through which the earth that is churned up by the crawler belt passes and falls to the ground. Thus earth removal can be precipitated favorably.

Incidentally, various loads act on the slewing body 102 of the hydraulic shovel 100, on which the working device 107 is provided, during an operation.

However, the conventional truck frames 108 are constituted by sheet metal, as shown in FIG. 10C, and hence a vertical plate may be provided below the circular core 110 to which the slewing body 102 is connected, and a vertical plate 120 is provided between the upper plate portion 111A and lower plate portion 111B.

Hence stress that is generated by a load transmitted to the circular core 110 which supports the slewing body 102 is transferred smoothly to the vertical plate 120 from the circular core 110, thus eliminating problems relating to strength.

When the truck frame portions and central rotary case portion are constituted separately and joined via connecting members, however, the length of the connecting members is preferably set at no more than a predetermined length from the point of view of problems regarding the strength of the connecting members and the prevention of increases in the moment of loads generated during travel. To shorten the connecting members, a side plate of the rotary case portion to which the connecting members are joined must be formed so as to jut out from the connecting member side.

In this case, the side plate of the rotary case portion is provided at a remove from the location of the upper plate of the rotary case portion on which the slewing body is mounted, and as a result, loads transmitted from the slewing body are transferred to the upper plate having low load-withstanding strength, leading to possible breakage of the rotary case portion depending on the structure thereof.

SUMMARY OF THE INVENTION

The present invention has been designed in consideration of this situation, and it is an object thereof to provide a construction machine in which a load that is transmitted during an operation is transferred to a location having good rigidity, thereby securing the strength of a vehicle body, and which is also capable of realizing an increase in the load-withstanding strength in relation to a load that is applied during travel, thereby improving reliability.

A construction machine according to a first invention comprises a lower traveling body having a frame and an upper slewing body which slews freely about the lower traveling body, the frame of the lower traveling body comprising a hollow center frame having an upper plate, a lower plate, and side plates surrounding sides thereof, the upper plate being formed with an attachment ring on which a slewing bearing of the upper slewing body is mounted; a pair of truck frames disposed on outside of two side portions of the center frame; and connecting members for connecting the center frame to the truck frames, center joining portions of the connecting members being welded to the side plates of the center frame, wherein the center frame comprises the side plates positioned so as to jut out from the attachment ring, and reinforcing ribs which connect the upper plate to the lower plate in an interior of the center frame beneath the attachment ring.

According to this constitution, the reinforcing rib is provided in the interior of the center frame beneath the attachment ring for connecting the upper plate to the lower plate, and hence an operating load from the upper slewing body that is transmitted to the attachment ring is transferred to the highly rigid reinforcing rib and dispersed over the center frame.

Hence the load-withstanding strength of the center frame to operating loads is secured, leading to an improvement in the reliability of the vehicle body.

Moreover, the center frame comprises the side plate which are positioned so as to jut out from the attachment ring, and hence the length of the connecting member which connects the center frame to the truck frames can be reduced. As a result, increases in the moment of a load that is generated during traveling and transmitted to the connecting member can be prevented, and such loads can be received in the strong center frame.

Hence the load-withstanding strength of the center frame to running loads is secured, leading to an improvement in the reliability of the vehicle body.

In a construction machine according to a second invention, pertaining to the construction machine according to the first invention, the reinforcing rib has a U-shaped form when seen from above.

According to this constitution, the reinforcing rib has a U-shaped form when seen from above, and hence rigidity is high in relation to compressive loads, tensile loads, bending moments, and so on which act on the center frame. Thus the load-withstanding strength of the center frame can be improved.

In a construction machine according to a third or a fourth invention, pertaining to the construction machine according to the first or second invention, the reinforcing rib is provided on inside of the center frame and inside of the joining portion of the connecting member, or extending along a line of extension of a vertical plate of the connecting member.

According to this constitution, the reinforcing rib is provided on the inside of the center frame and the inside of the joining portion of the connecting member, or extending along the line of extension of a vertical plate of the connecting member, and hence a load from the connecting member can be received in the reinforcing rib which is disposed along the transmission direction, and can thus be dispersed smoothly to the center frame.

A construction machine according to a fifth invention comprises a lower traveling body having a frame and an upper stewing body which slews freely about the lower traveling body, the frame of the lower traveling body comprising a hollow center frame having an upper plate, a lower plate, and side plates surrounding sides thereof, the upper plate being formed with an attachment ring on which a slewing bearing of the upper slewing body is mounted; a pair of truck frames disposed on outside of two side portions of the center frame; and connecting members for connecting the center frame to the truck frames, the center joining portions of the connecting members being welded to the side plates of the center frame, wherein the side plate of the center frame is formed in a position jutting out from the attachment ring, and comprises a reinforcing plate portion which recedes inward below the attachment ring at an intermediate portion of locations at which the center joining portion of the connecting member is joined.

According to this constitution, the side plate of the center frame comprises a reinforcing plate portion which recedes inward below the attachment ring at an intermediate portion of the locations at which the center joining portion of the connecting member is joined, and hence an operating load from the upper slewing body that is transmitted to the attachment ring is transferred to the side plate provided with the highly rigid reinforcing plate portion, and dispersed over the center frame.

Hence the load-withstanding strength of the center frame to operating loads is secured, leading to an improvement in the reliability of the vehicle body.

Further, the side plate of the center frame is formed in a position jutting out from the attachment ring, and hence the length of the connecting member which connects the center frame to the truck frames can be reduced. As a result, increases in the moment of a load that is generated during traveling and transmitted to the connecting member can be prevented, and such loads can be received in the strong center frame.

Hence the load-withstanding strength of the center frame to running loads is secured, leading to an improvement in the reliability of the vehicle body. In a construction machine according to a sixth invention, pertaining to the construction machine according to the fifth invention, the reinforcing plate portion is provided on inside of the center frame and inside of the joining portion of the connecting member, or extending along a line of extension of a vertical plate of the connecting member.

According to this constitution, the reinforcing plate portion is provided on inside of the center frame and inside of the joining portion of the connecting member, or extending along the line of extension of a vertical plate of the connecting member, and hence a transfer load from the connecting member can be received in the reinforcing plate portion which is disposed along the transmission direction, and can thus be dispersed smoothly to the center frame.

DESCRIPTION OF THE PREFERRED EMBODIMENTS

The present invention will be described in detail below on the basis of the drawings illustrating embodiments thereof.

Figure 1:
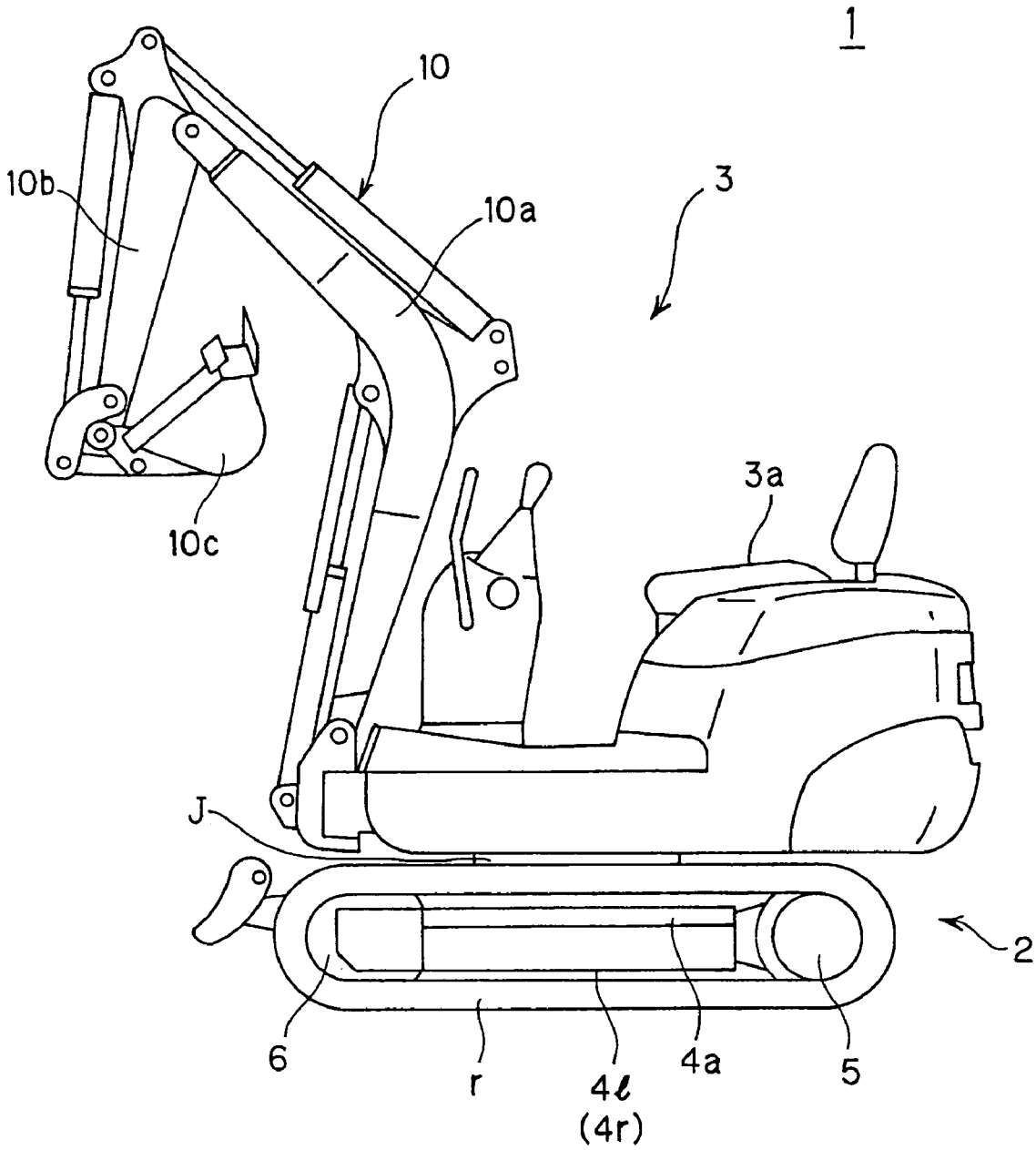
FIG. 1 is a side view showing a hydraulic shovel of an embodiment according to the present invention.

As shown in FIG. 1, a hydraulic shovel 1 according to a first embodiment of the present invention comprises a lower traveling body 2 provided with a crawler belt r to enable motion, and an upper slewing body 3 which is attached slewably to the top of the lower traveling body 2 via a slewing bearing J, and which is mounted by an operator to perform an operation.

An operating seat 3*a* on which the operator sits to perform an operation is provided on the upper slewing body 3, and a working machine 10 comprising a boom 10*a*, an arm 10*b*, and an excavating bucket 10*c* attached to the tip end of the arm 10*b*, which are hydraulically driven, is axially supported in a vertical direction to the front of the operating seat 3*a* so as to swing freely.

As a result of this constitution, various loads act on the upper slewing body 3, to which the working device 10 comprising the bucket 10*c* is attached, during an operation.

In the lower traveling body 2, a drive shaft 5 and a pivot 6 are attached respectively to the two end portions of truck frames 4*l*, 4*r*, and the crawler belt r is wrapped around the drive shaft 5 and pivot 6.

The hydraulic shovel 1 is driven by starting a traction motor such that the power thereof is transmitted to the drive shaft 5. This causes the drive shaft 5 to rotate, which drives the crawler belt r to rotate, and as a result, traveling is performed.

An outer ring (not shown) of the slewing bearing J is attached to the upper slewing body 3, and an inner ring (not shown) of the slewing bearing J is fastened to an attachment ring 7*r* (to be described below, see FIGS. 2, 3) of a center frame 7 by bolts. An internal gear is formed on the inner peripheral face of the inner ring of the slewing bearing J, this internal gear meshing with a pinion gear (not shown) that is driven by a slewing motor (not shown) attached to the upper stewing body 3.

By driving the slewing motor, the inner ring is caused to rotate relative to the outer ring, and hence the upper slewing body 3 is driven to slew relative to the lower traveling body 2.

Figure 2:
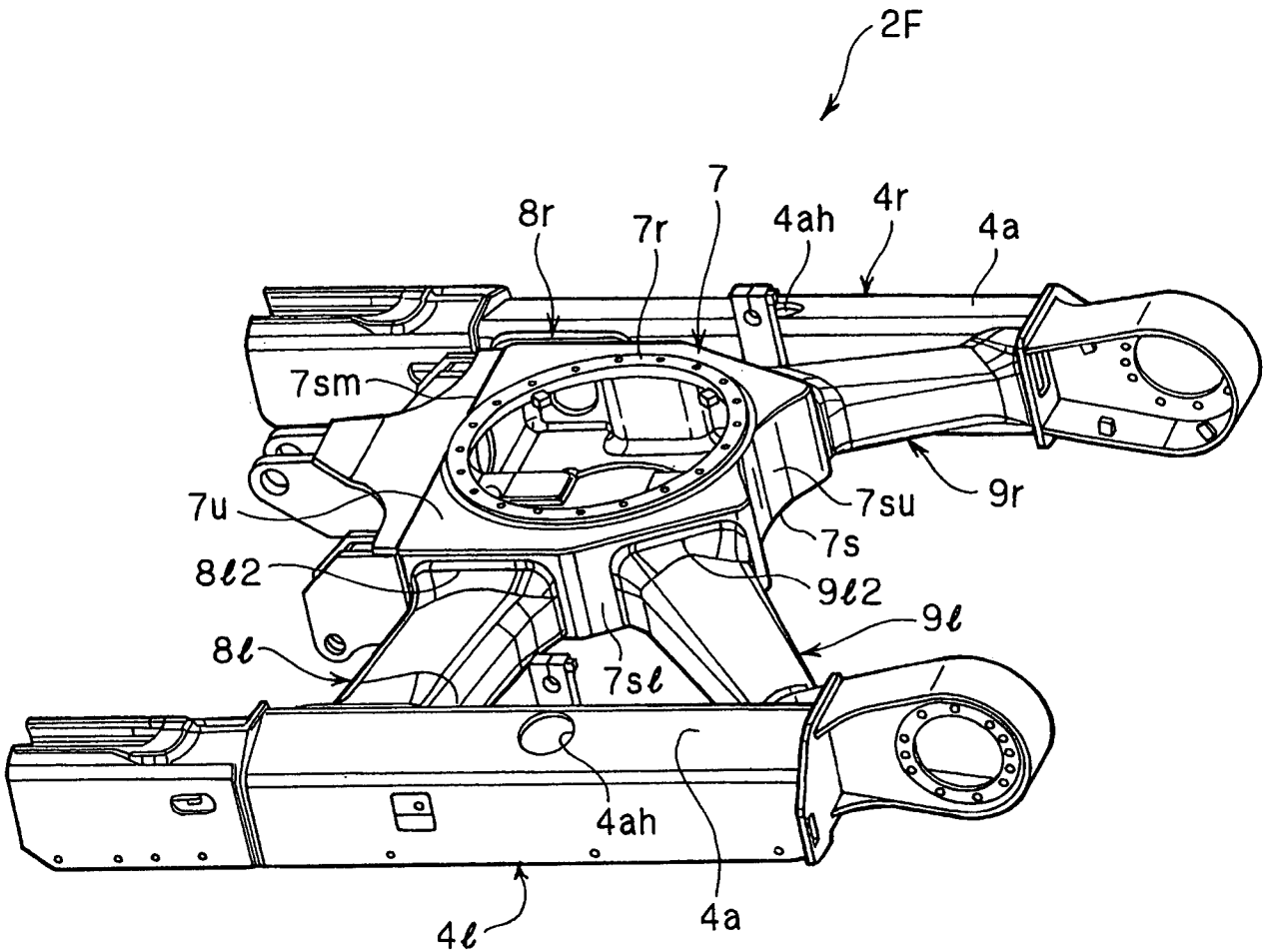
FIG. 2 is a perspective view of the frame of a lower traveling body in the hydraulic shovel of a first embodiment according to the present invention.
Figure 3:
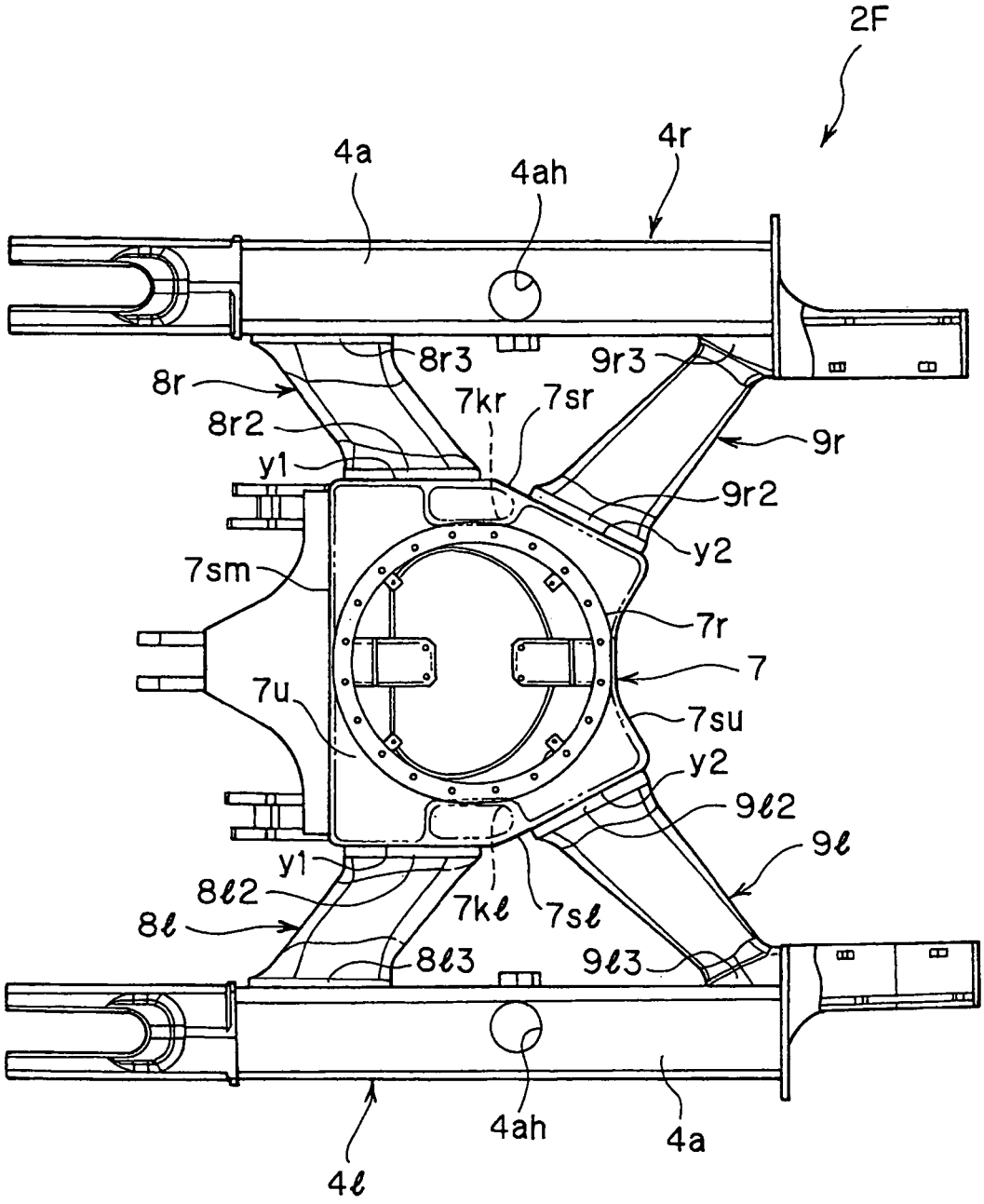
FIG. 3 is a top view of the frame of the lower traveling body in the hydraulic shovel of the first embodiment according to the present invention.

As shown in FIG. 2 and the top view of FIG. 3, the center frame 7 formed with the attachment ring 7*r*, on which the slewing bearing J is mounted, is disposed in the central portion of a frame 2F of the lower traveling body, and the truck frames 4*r*, 4*l* are disposed on the two side portions thereof. The truck frame 4*r* is connected to the center frame 7 by two leg-shaped connecting members 8*r*, 9*r*, and the truck frame 4*l* is connected to the center frame 7 by two leg-shaped connecting members 8*l*, 9*l*.

These members are joined to each other by welding.

Here, reinforcing ribs 7*kr*, 7*kl* for smoothly dispersing stress generated by a load that is transmitted from the upper slewing body 3 to the attachment ring 7*r* over the center frame 7 are disposed directly beneath or approximately beneath the attachment ring 7*r* in the interior of the center frame 7 along the load transmission direction so as to connect an upper plate 7*u* and a lower plate 7*s*.

Note that as shown in FIG. 3, the truck frame 4*r* and the pair of connecting members 8*r*, 9*r*, and the truck frame 4*l* and the pair of connecting members 8*l*, 9*l* are constituted in plane symmetry about a central face (the center line of the vertical direction of the center frame 7 in FIG. 3) of the center frame 7 in the direction of width (the vertical direction in FIG. 3).

More specifically, in FIG. 3, the connecting member 8*r* and connecting member 8*l* take a symmetrical form about the central face of the center frame 7 in the direction of width, and the connecting member 9*r* and connecting member 9*l* take a symmetrical form about the central face of the center frame 7 in the direction of width.

Figures 4A, 4B, 4C:
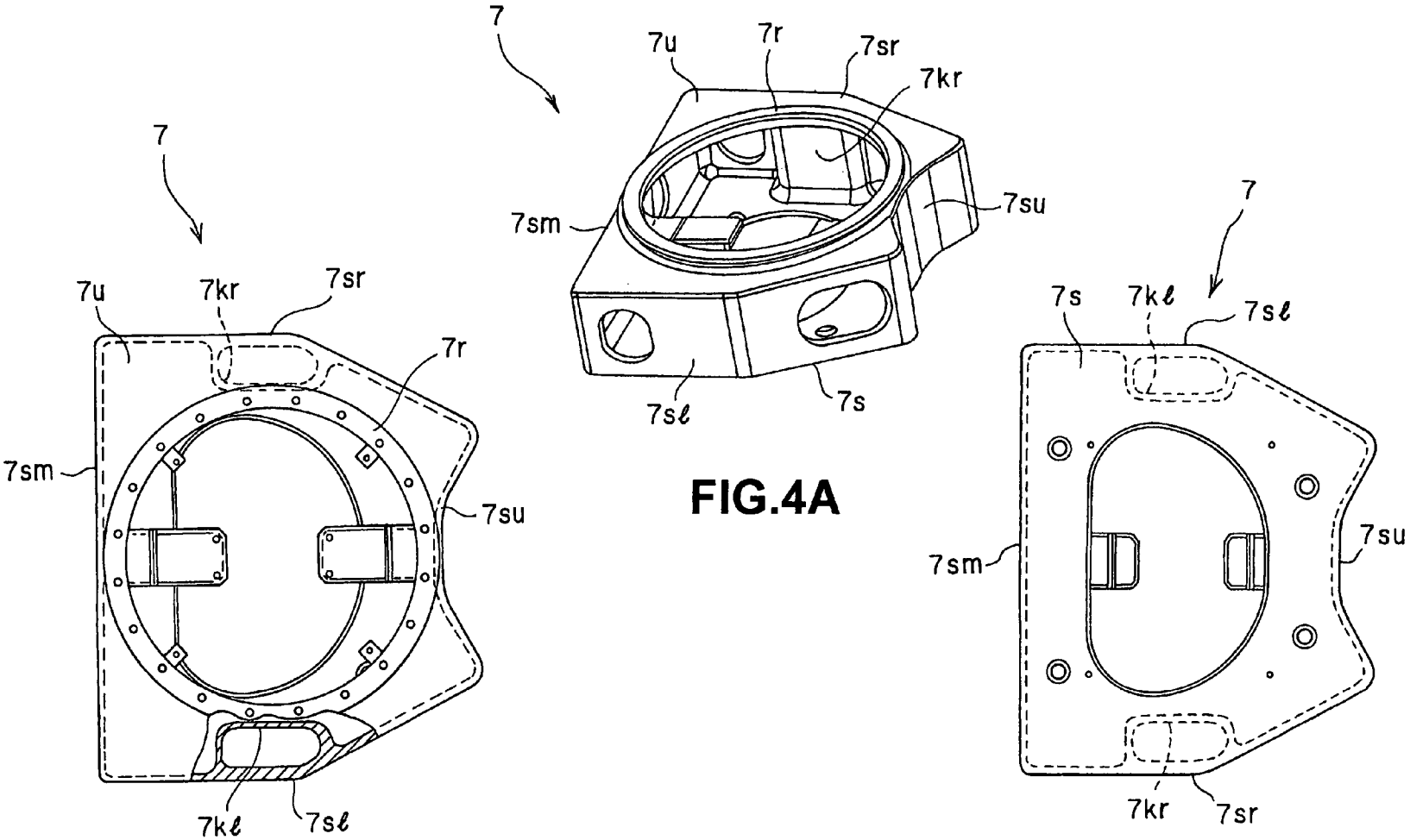
FIGS. 4A, 4B, and 4C are a perspective view, a partially cut-away top view, and a bottom view showing a center frame of the hydraulic shovel of the first embodiment according to the present invention.

The center frame 7 is manufactured as a cast using cast steel, and as shown in FIG. 4A, the top view in FIG. 4B, and the bottom view in FIG. 4C, is constituted in a hollow box form comprising a front side plate 7*sm*, a rear side plate 7*su*, a right side plate 7*sr* to which the connecting members 8*r*, 9*r* are joined, a left side plate 7*sl* to which the connecting members 8*l*, 9*l* are joined, the upper plate 7*u* in which the attachment ring 7*r* is formed, and the lower plate 7*s*.

Note that the lower plate 7*s* is welded from below, and improves the strength of the center frame 7 by blocking the internal space of the center frame 7.

The attachment ring 7*r*, to which the inner ring of the stewing bearing J that is fixed to the upper slewing body 3 is attached by bolts, is formed in the upper plate 7*u* of the center frame 7, and comprises an opening in its central portion.

In the interior of the center frame 7 directly beneath or approximately beneath the attachment ring 7*r*, the reinforcing rib 7*kr* is formed inward in continuation from the right side plate 7*sr* so as to connect the upper plate 7*u* and lower plate 7*s*, and the reinforcing rib 7*kl* is formed inward in continuation from the left side plate 7*sl* so as to connect the upper plate 7*u* and lower plate 7*s*, as shown in FIGS. 3, 4A, 4B, and 4C.

The reinforcing rib 7*kr* and the reinforcing rib 7*kl* are also formed along the transmission direction of a load that is transmitted from the upper slewing body 3 to the attachment ring 7*r*.

Hence, a load from the upper stewing body 3 that is generated by the working device 10 and transmitted to the attachment ring 7*r* is transferred to the center frame 7 via the reinforcing ribs 7*kr*, 7*kl* which are formed along the load transmission direction and have better load-withstanding strength and rigidity than the upper plate 7*u* which is flat, formed perpendicular to the load transmission direction, and cannot be the to have good strength in relation to loads.

By forming the reinforcing ribs 7*kr*, 7*kl* in a U-shaped form when seen from above in this manner, the load-withstanding strength of the center frame 7 can be improved in relation to compressive loads, tensile loads, bending moments, and so on that are transmitted to the attachment ring 7*r*.

Note that an example was described in which the reinforcing ribs 7*kr*, 7*kl* are formed in continuation from the right side plate 7*sr* and left side plate 7*sl* respectively, but the reinforcing ribs 7*kr*, 7*kl* need not be formed in continuation from the right side plate 7*sr* and left side plate 7*sl*.

Further, the reinforcing ribs 7*kr*, 7*kl* need not be formed integrally with the center frame 7 by casting, but may be formed by bending sheet metal in advance to produce members corresponding to the U-shaped reinforcing ribs 7*kr*, 7*kl*, and welding these members to predetermined locations within the center frame 7.

The front side plate 7*sm* and rear side plate 7*su* are formed directly beneath or approximately beneath the attachment ring 7*r* and extend in a vertical direction along the direction in which a load from the upper slewing body 3 is transmitted to the attachment ring 7*r*.

By forming the front side plate 7*sm* and rear side plate 7*su* along the transmission direction of a load from the upper slewing body 3 that is transmitted to the attachment ring 7*r* in this manner, loads transmitted to the attachment ring 7*r* are transferred smoothly to the front side plate 7*sm* and rear side plate 7*su* and dispersed over the center frame 7.

As shown in FIGS. 4A, 4B, 4C, the right side plate 7*sr* and left side plate 7*sl* are formed in positions jutting out from the attachment ring 7*r* of the center frame 7, and are formed in a flat plate form along a vertical direction which appears rectilinear when seen from above (see FIG. 3).

Figure 5A:
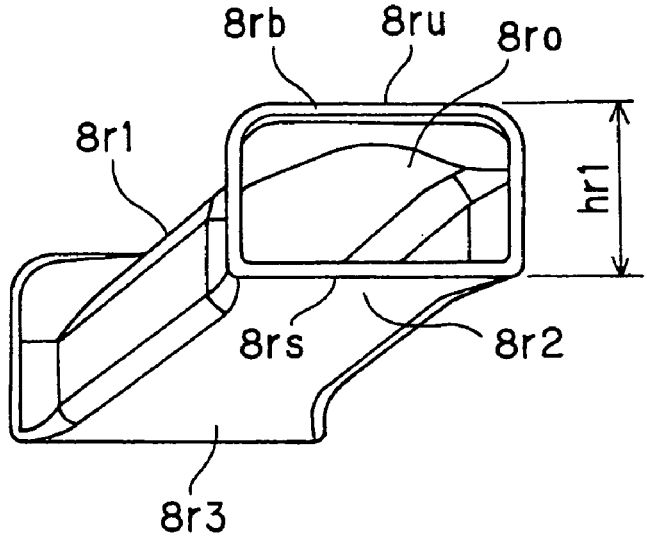
FIGS. 5A and 5B are perspective views of a connecting member of the hydraulic shovel of the first embodiment according to the present invention.

The connecting member 8*r* is manufactured as a cast using cast steel, and as shown in FIG. 5A (which is a perspective view of the connecting member 8*r* alone seen from the side of the center frame 7 shown in FIG. 3), is constituted in a hollow form comprising a core portion 8*r*1 having a substantially pentagonal cross section and provided with an angled portion at the upper portion thereof at which a ridge is formed in the longitudinal direction of the upper face, a center joining portion 8*r*2 having a quadrilateral cross section and formed with an opening 8*r*0, and a truck joining portion 8*r*3 formed with an opening.

The center joining portion 8*r*2 of the connecting member 8*r* comprises a joining face 8*rb* which is joined to the right side plate 7*sr* of the center frame 7, and as shown in FIG. 3, this joining face 8*rb* is formed in planar form to appear rectilinear when seen from above, and is thus non-perpendicular to the axis which runs along the direction in which the connecting member 8*r* extends.

Further, a height dimension hr1 between an upper face 8*ru* and a lower face 8*rs* of the center joining portion 8*r*2 having the joining face 8*rb* is set to be slightly shorter than the dimension between the upper and lower faces (the dimension between the upper face of the upper plate 7*u* and the lower face of the lower plate 7*s*) of the center frame 7 (see FIG. 2).

The connecting member 8*l* shown in FIGS. 2, 3 is manufactured as a cast using cast steel and, as described above, is constituted in plane symmetry with the connecting member 8*r* about the central face of the center frame 7 in the direction of width.

Similarly to the connecting member 8*r*, the connecting member 8*l* is constituted as a pipe-form hollow member extending in a longitudinal direction having a closed transverse section. Since the connecting member 8*l* is constituted similarly to the connecting member 8*r*, detailed description thereof has been omitted.

Figure 5B:
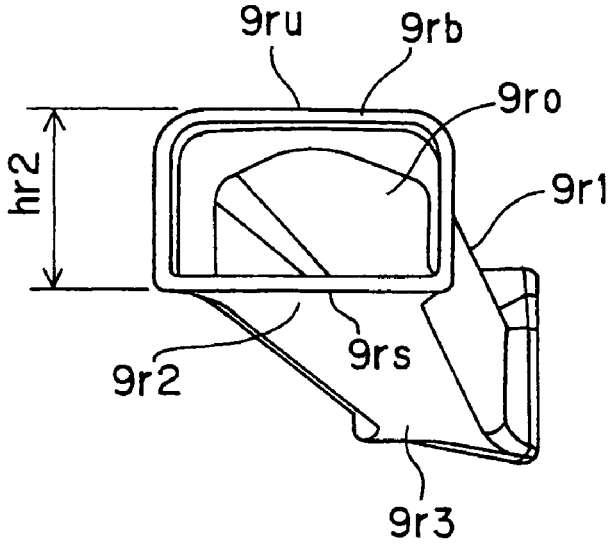

The connecting member 9*r* is manufactured as a cast using cast steel, and as shown in FIG. 5B (which is a perspective view of the connecting member 9*r* alone seen from the center frame side in FIG. 3), is constituted in a hollow form comprising a tapered core portion 9*r*1 having a substantially pentagonal cross section and provided with an angled portion at the upper portion thereof at which a ridge is formed in the longitudinal direction of the upper face, a center joining portion 9*r*2 having a quadrilateral cross section and formed with an opening 9*r*0, and a truck joining portion 9*r*3 formed with an opening.

The center joining portion 9*r*2 of the connecting member 9*r* comprises a joining face 9*rb* which is joined to the right side plate 7*sr* of the center frame 7, and as shown in FIG. 3, this joining face 9*rb* is formed in planar form to form a straight line when seen from above, and is thus non-perpendicular to the axis which runs along the direction in which the connecting member 9*r* extends.

Further, a height dimension hr2 between an upper face 9*ru* and a lower face 9*rs* of the center joining portion 9*r*2 having the joining face 9*rb* is set to be slightly shorter than the dimension between the upper and lower faces (the dimension between the upper face of the upper plate 7*u* and the lower face of the lower plate 7*s*) of the center frame 7 (see FIG. 2).

The connecting member 9*l* shown in FIGS. 2, 3 is manufactured as a cast using cast steel and, as described above, is constituted in plane symmetry with the connecting member 9*r* about the central face of the center frame 7 in the direction of width.

Similarly to the connecting member 9*r*, the connecting member 9*l* is constituted as a tapered, pipe-form hollow member extending in a longitudinal direction having a closed transverse section. Since the connecting member 9*l* is constituted similarly to the connecting member 9*r*, detailed description thereof has been omitted.

As described above, the connecting members 8*r*, 8*l*, 9*r*, 9*l* are constituted in a form having a ridge with an angled portion on the upper face thereof, and hence earth that is churned up by the crawler belt r during traveling slides down the inclined surface of the upper face of the connecting members 8*r*, 8*l*, 9*r*, 9*l* and falls to the ground, thus prevented the accumulation thereof on top of the connecting members 8*r*, 8*l*, 9*r*, 9*l*.

The truck frames 4*r*, 4*l* extend in a front-rear direction (the left/right direction in FIGS. 1, 2, and 3) and have a quadrilateral cross section. As shown in FIG. 2, the upper face portion thereof is constituted with an inclined face plate 4*a* forming a singly tapered face which inclines downward toward the outside of the vehicle body. An earth removing hole 4*ah* is pierced through the inclined face plate 4*a* of the truck frames 4 near the center thereof.

Next, a method of joining the center frame 7 to the connecting members 8*r*, 8*l*, 9*r*, 9*l* will be described.

As shown in FIGS. 2 and 3, when the center frame 7 is joined to the connecting member 8*r*, the center joining portion 8*r*2 on the connecting member 8*r* is disposed in an intermediate position in the vertical direction of the right side plate 7*sr* of the center frame 7, whereupon welding is performed at a welding location y1 between the right side plate 7*sr* of the center frame 7 and the center joining portion 8*r*2 of the connecting member 8*r*.

Welding between the center frame 7 and the connecting member 8*l* is performed similarly to the welding described above between the center frame 7 and connecting member 8*r*.

Further, as shown in FIGS. 2 and 3, when the center frame 7 is joined to the connecting member 9*r*, the center joining portion 9*r*2 on the connecting member 9*r* is disposed in an intermediate position in the vertical direction of the right side plate 7*sr* of the center frame 7, whereupon welding is performed at a welding location y2 between the right side plate 7*sr* of the center frame 7 and the center joining portion 9*r*2 of the connecting member 9*r*.

Welding between the center frame 7 and the connecting member 9*l* is performed similarly to the welding described above between the center frame 7 and connecting member 9*r*.

Note that in this embodiment, an example was described in which the connecting members 8*r*, 8*l*, 9*r*, 9*l* are manufactured as casts, but the connecting members 8*r*, 8*l*, 9*r*, 9*l* are not limited to casts, and may be manufactured from sheet metal.

According to the constitution described above, various loads act on the upper slewing body 3 provided with the working device 10 during an operation of the bucket 10*c*, and these loads are transmitted to the attachment ring 7*r* of the center frame 7 which is connected to the upper stewing body 3 via the slewing bearing J.

However, the reinforcing ribs 7*kr*, 7*kl* which connect the upper plate 7*u* and lower plate 7*s* are formed directly beneath or approximately beneath the attachment ring 7*r* in the interior of the center frame 7, and these reinforcing ribs 7*kr*, 7*kl* extend in the direction in which the aforementioned loads are transmitted.

Hence the loads are transferred to the reinforcing ribs 7*kr*, 7*kl*, which have good rigidity in relation to loads, and then dispersed over the center frame 7 via the reinforcing ribs 7*kr*, 7*kl*, and thus the load-withstanding strength of the center frame 7 to operating loads is improved, leading to an improvement in the reliability of the vehicle body.

Since a load that is transmitted to the attachment ring 7*r* from the upper slewing body 3 is dispersed smoothly over the center frame 7 via the reinforcing ribs 7*kr*, 7*kl*, the strength required by the right side plate 7*sr* and left side plate 7*sl* to transmit the load to the center frame 7 decreases relatively.

As a result, design freedom regarding the positioning of the right side plate 7*sr* and left side plate 7*sl* is increased.

Thus, in the design process, the right side plate 7*sr* and left side plate 7*sl* may be formed in positions removed and jutting out from the attachment ring 7*r*, enabling the length of the connecting members 8*r*, 9*r* connecting the center frame 7 to the truck frame 4*r* and the connecting members 8*l*, 9*l* connecting the center frame 7 to the truck frame 4*l* to be shortened as required.

Here, the hydraulic shovel 1 travels over various ground surfaces by driving the crawler belts r, r to rotate, and hence loads of varying magnitudes act on the respective truck frames 4*r*, 4*l*.

These loads are transmitted respectively to the connecting members 8*r*, 9*r* that are connected to the truck frame 4*r* and the connecting members 8*l*, 9*l* that are connected to the truck frame 4*l*.

By forming the connecting members 8*r*, 8*l*, 9*r*, 9*l* to be as short as possible, the length of the moment lever caused by a load generated during traveling can be shortened, thereby preventing increases in the moment.

Moreover, since the connecting members 8*r*, 8*l*, 9*r*, 9*l* are formed as pipe-form hollow members due to weight considerations and therefore have low load-withstanding strength, in this regard also it is advantageous to be able to shorten the connecting members 8*r*, 8*l*, 9*r*, 9*l*.

As a result, loads generated during traveling can be received in the strong center frame 7 through the short connecting members 8*r*, 8*l*, 9*r*, 9*l*.

Thus the load-withstanding strength of the vehicle body to loads generated during traveling is ensured, and reliability is improved.

Next, first and second modified examples of the reinforcing ribs 7*kr*, 7*kl* of the center frame 7 in the first embodiment will be described using FIGS. 6A, 6B.

Note that since the reinforcing rib 7*kl* on the side of the connecting members 8*l*, 9*l* and the reinforcing rib 7*kr* on the side of the connecting members 8*r*, 9*r* are symmetrical about the central face of the center frame 7 in the direction of width and have similar constitutions, only the reinforcing rib 7*kr* is described, and description of the reinforcing rib 7*kl* is omitted.

Figure 6A:
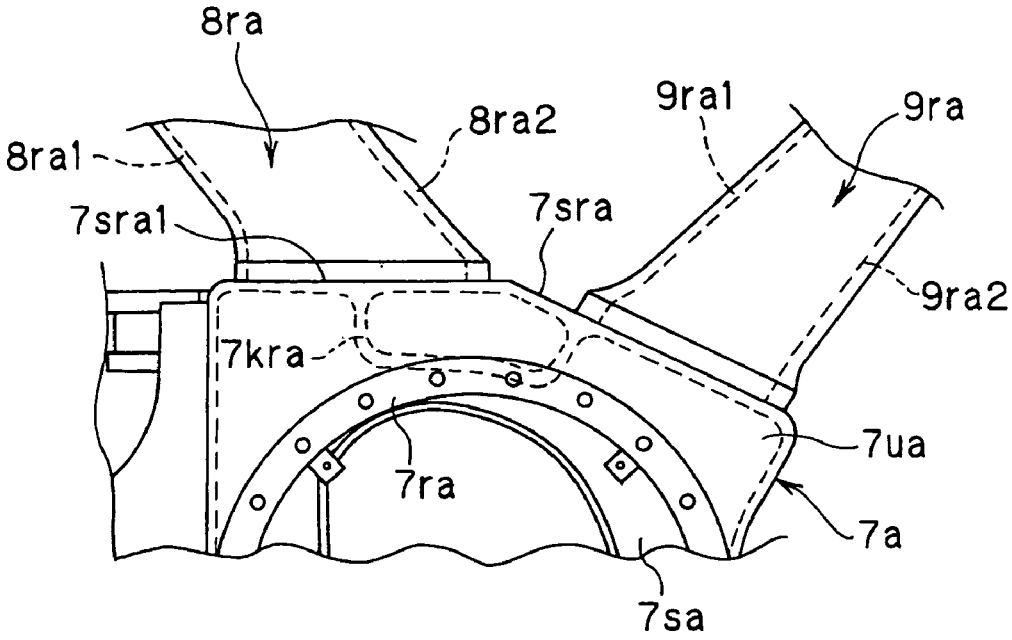
FIGS. 6A and 6B are a conceptual top view of a first modified example and a conceptual top view of a second modified example of a joining portion between the center frame and connecting member in the first embodiment according to the present invention.

FIG. 6A is a conceptual top view of the vicinity of the joining portion between a center frame 7*a* and connecting members 8*ra*, 9*ra*, illustrating the first modified example.

In the first modified example, a reinforcing rib 7*kra* extends inward when seen from above from the inside of a joining portion 7*sra*1 between a right side plate 7*sra* of the center frame 7*a* and the connecting member 8*ra*, passes through the interior of the center frame 7*a* below the attachment ring 7*ra* or in the vicinity thereof, and connects to the right side plate 7*sra* along the line of extension of a front vertical plate 9*ra*1 of the connecting member 9*ra*.

Simultaneously, the reinforcing rib 7*kra* is formed integrally with an upper plate 7*ua* of the center frame 7*a* and extends to a lower plate 7*sa* in a vertical direction (a perpendicular direction to the paper surface in FIG. 6A).

According to the first modified example, the reinforcing rib 7*kra* extends inward from the inside of the joining portion 7*sra*1 between the right side plate 7*sra* of the center frame 7*a* and the connecting member 8*ra*, and hence a load that is transmitted to the center frame 7*a* from the connecting member 8*ra* can be received in the reinforcing rib 7*kra* along the line of extension of the connecting member 8*ra*, which is the load transmission direction.

Running loads from the truck frame 4*r* are transmitted to the connecting member 9*ra*, and these loads are transferred to the right side plate 7*sra* of the center frame 7*a* via the front vertical plate 9*ra*1, rear vertical plate 9*ra*2, and so on forming the connecting member 9*ra*. However, by forming the reinforcing rib 7*kra* along the line of extension of the front vertical plate 9*ra*1 of the connecting member 9*ra*, these loads can be received in the reinforcing rib 7*kra* extending along the transmission direction.

Hence a transfer load from the connecting member 8*ra* and connecting member 9*ra* can be dispersed smoothly over the center frame 7*a* without applying an excessive structural load thereto.

Note that in the first modified example, an example was described in which the reinforcing rib 7*kra* is formed on the line of extension of the front vertical plate 9*ra*1 of the connecting member 9*ra*, but the reinforcing rib 7*kra* may be provided on the line of extension of the front vertical plate 8*ra*1 and rear vertical plate 8*ra*2 of the connecting member 8*ra*, or on the line of extension of the rear vertical plate 9*ra*2 of the connecting member 9*ra*.

Figure 6B:
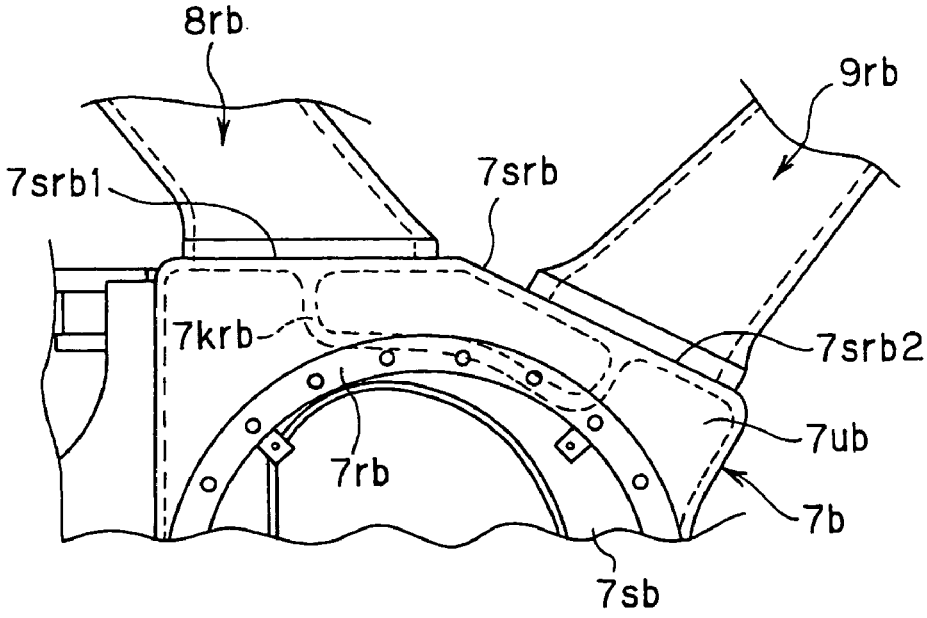

FIG. 6B is a conceptual top view of the vicinity of the joining portion between a center frame 7*b* and connecting members 8*rb*, 9*rb*, illustrating the second modified example.

In the second modified example, a reinforcing rib 7*krb* extends inward when seen from above from the inside of a joining portion 7*srb*1 between a right side plate 7*srb* of the center frame 7*b* and the connecting member 8*rb*, passes through the interior of the center frame 7*b* below the attachment ring 7*rb* or in the vicinity thereof, and connects to the inside of a joining portion 7*srb*2 between the right side plate 7*srb* and the connecting member 9*rb*.

Simultaneously, the reinforcing rib 7*krb* is formed integrally with an upper plate 7*ub* of the center frame 7*b* and extends to a lower plate 7*sb* in a vertical direction (a perpendicular direction to the paper surface in FIG. 6B).

According to the second modified example, the reinforcing rib 7*krb* extends inward from the inside of the joining portions 7*srb*1, 7*srb*2 between the right side plate 7*srb* of the center frame 7*b* and the connecting members 8*rb*, 9*rb*, and hence a load that is transmitted to the center frame 7*b* from the connecting members 8*rb*, 9*rb* can be received in the reinforcing rib 7*krb* which exists on the line of extension of the connecting members 8*rb*, 9*rb*, or in other words along the load transmission direction. Hence this load can be dispersed smoothly over the center frame 7*b* without applying an excessive structural load thereto.

Note that in both the first and second modified examples, the reinforcing ribs are molded into a U-shaped form when seen from above, and hence the reinforcing ribs are firmly supported in relation to compressive loads, tensile loads, bending moments, and so on that are transmitted to the attachment ring, thus enabling improvements in the load-withstanding strength of the center frame.

Thus the reinforcing ribs are able to improve the load-withstanding strength of the center frame in relation to loads that are transmitted to the center frame from the connecting members as well as loads that are transmitted to the attachment ring.

Note that the reinforcing ribs need not be formed integrally with the center frame by casting, but may also be formed by bending sheet metal in advance to produce members corresponding to the U-shaped reinforcing ribs, and welding these members to predetermined locations within the center frame.

In the first and second modified examples, a description was provided in which the reinforcing ribs 7*kra*, 7*krb* take a continuous U-shaped form, but the reinforcing ribs 7*kra*, 7*krb* may take an interrupted U-shaped form instead of a continuous form.

Further, as long as the reinforcing ribs 7*kra*, 7*krb* take a U-shaped form, this may be a substantially U-shaped form or the like, and need not be a strictly U-shaped form.

Next, a second embodiment will be described.

In the second embodiment, the reinforcing ribs 7*kr*, 7*kl* of the first embodiment are not provided below the attachment ring 7*r* in the interior of the center frame 7, but are substituted for the right side plate 7*sr* and left side plate 7*sl*.

All other constitutions are identical to those of the first embodiment. Hence identical constitutional elements to those of the first embodiment are illustrated by adding to the same reference symbol, and detailed description of these elements is omitted.

Figure 7:
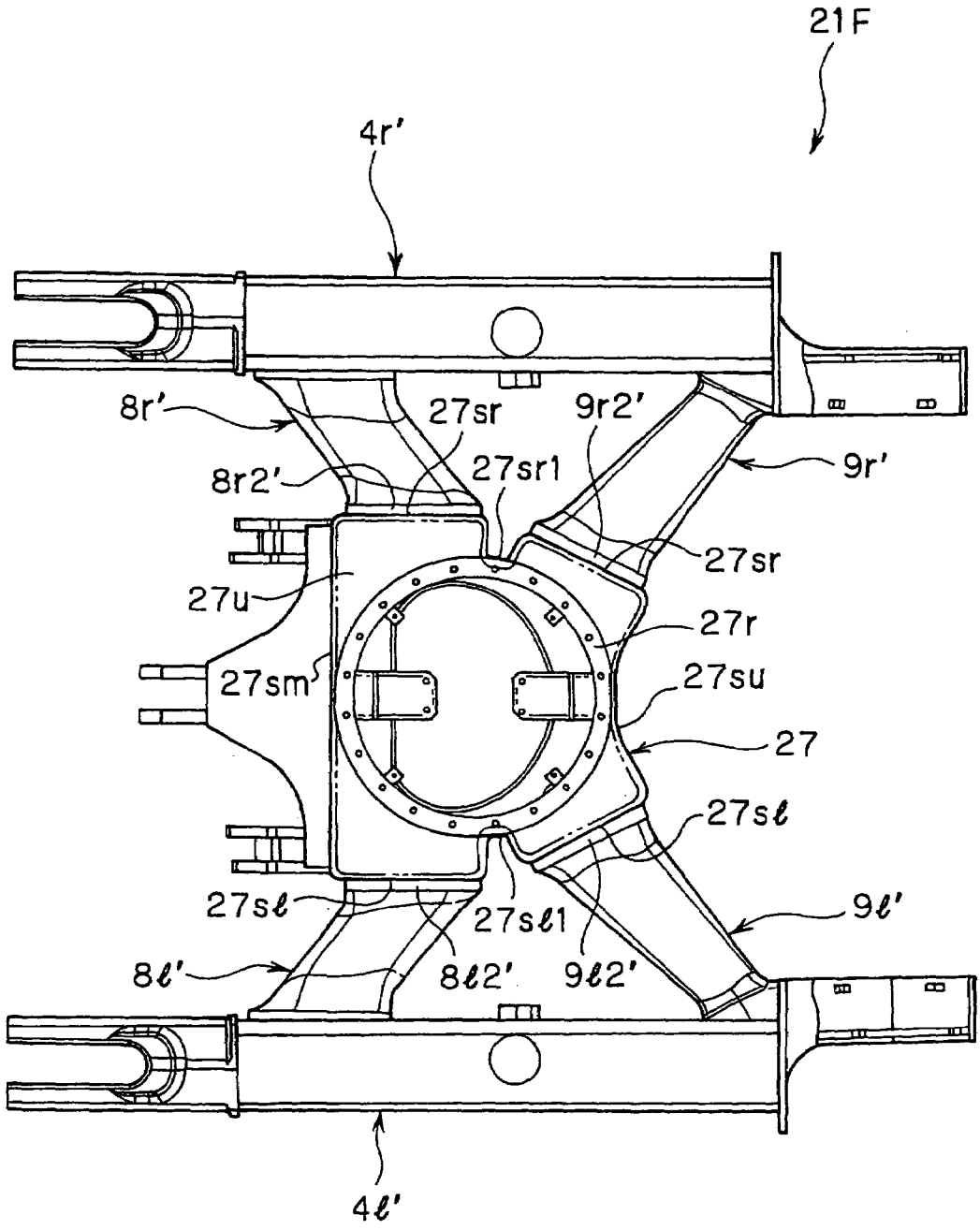
FIG. 7 is a top view of a frame of a lower traveling body in a hydraulic shovel of a second embodiment according to the present invention.

As shown in the top view in FIG. 7, a center frame 27 is disposed in the central portion of a frame 21F of the lower traveling body, and truck frames 4*r*', 4*l*' are disposed on the two side portions thereof. The truck frame 4*r*' is connected to the center frame 27 by two leg-shaped connecting members 8*r*', 9*r*', and the truck frame 4*l*' is connected to the center frame 27 by two leg-shaped connecting members 8*l*', 9*l*'.

These members are joined to each other by welding.

The center frame 27 is manufactured as a cast using cast steel, and is constituted in a hollow box form comprising an upper plate 27*u* formed with an attachment ring 27*r* on which a stewing bearing J' is mounted, a lower plate, a front side plate 27*sm*, a rear side plate 27*su*, a right side plate 27*sr* to which the connecting members 8*r*', 9*r*' are joined, and a left side plate 27*sl* to which the connecting members 8*l*', 9*l*' are joined.

The right side plate 27*sr* of the center frame 27 is formed in a position jutting out from the side portion of the attachment ring 27*r*, and the left side plate 27*sl* is formed in a position jutting out from the side portion of the attachment ring 27*r*.

A reinforcing plate portion 27*sr*1 which recedes inward below the attachment ring 27*r* between the locations at which the connecting members 8*r*', 9*r*' are joined is formed on the right side plate 27*sr* of the center frame 27.

The reinforcing plate portion 27*sr*1 is formed extending in a vertical direction along the transmission direction of a load from the upper slewing body 3' that is transmitted to the attachment ring 27*r*.

Thus an operating load from the upper stewing body 3' that is transmitted to the attachment ring 27*r* is transferred to the reinforcing plate portion 27*sr*1 and dispersed over the center frame 27, enabling an improvement in the load-withstanding strength of the center frame 27 in relation to operating loads.

Likewise, a reinforcing plate portion 27*sl*1 which recedes inward below the attachment ring 27*r* between the locations at which the connecting members 8*l*', 9*l*' are joined is formed on the left side plate 27*sl* of the center frame 27.

The reinforcing plate portion 27*sl*1 is formed extending in a vertical direction along the transmission direction of a load from the upper slewing body 3' that is transmitted to the attachment ring 27*r*.

Thus an operating load from the upper slewing body 3' that is transmitted to the attachment ring 27*r* is transferred to the reinforcing plate portion 27*sl*1 and dispersed over the center frame 27, enabling an improvement in the load-withstanding strength of the center frame 27 in relation to operating loads.

Further, the right side plate 27*sr* and left side plate 27*sl* are formed respectively in positions jutting out from the side portion of the attachment ring 27*r*, thus reducing the length of the connecting members 8*r*', 9*r*' that are joined to the right side plate 27*sr* and the length of the connecting members 8*l*', 9*l*' that are joined to the left side plate 27*sl*.

Moreover, the front side plate 27*sm* and rear side plate 27*su* are formed directly beneath or approximately beneath the attachment ring 27*r*, and hence a load from the upper slewing body 3' that is transmitted to the attachment ring 27*r* is transferred smoothly to the front side plate 27*sm* and rear side plate 27*su* which are formed in a vertical direction along the transmission direction of the load, and have good strength in relation to the load, whereupon the load is dispersed over the center frame 27.

According to this constitution, the reinforcing plate portion 27*sr*1 of the right side plate 27*sr* and the reinforcing plate portion 27*sl*1 of the left side plate 27*sl* are formed beneath the attachment ring 27*r* in the center frame 27, and hence a load from the upper slewing body 3' that is transmitted to the attachment ring 27*r* is transferred smoothly to the right side plate 27*sr* and left side plate 27*sl* which, comprising the reinforcing plate portion 27*sr*1 and the reinforcing plate portion 27*sl*1 respectively, have improved strength and rigidity in relation to the load. The load is thus dispersed over the center frame 27.

As a result, similarly to the first embodiment, the load-withstanding strength of the center frame 27 to operating loads is improved, leading to an improvement in the reliability of the vehicle body.

Thus the reinforcing plate portion 27*sr*1 of the right side plate 27*sr* is formed so as to recede inward below the attachment ring 27*r*, the reinforcing plate portion 27*sl* of the left side plate 27*sl* is formed so as to recede inward below the attachment ring 27*r*, and the right side plate 27*sr* and left side plate 27*sl* are formed in positions jutting out from the attachment ring 27*r*.

As a result, the length of the connecting members 8*r*', 9*r*' connecting the center frame 27 to the truck frame 4*r*' can be shortened, and similarly, the length of the connecting members 8*l*', 9*l*' connecting the center frame 27 to the truck frame 4*l*' can be shortened.

Hence, similarly to the first embodiment, a load generated during traveling can be received in the strong center frame 27 through the short connecting members 8*r*', 9*r*', 8*l*', 9*l*'.

Thus the load-withstanding strength of the vehicle body to loads generated during traveling is ensured, and reliability is improved.

In this manner, similar effects to those of the first embodiment can be achieved in the second embodiment.

Figure 8:
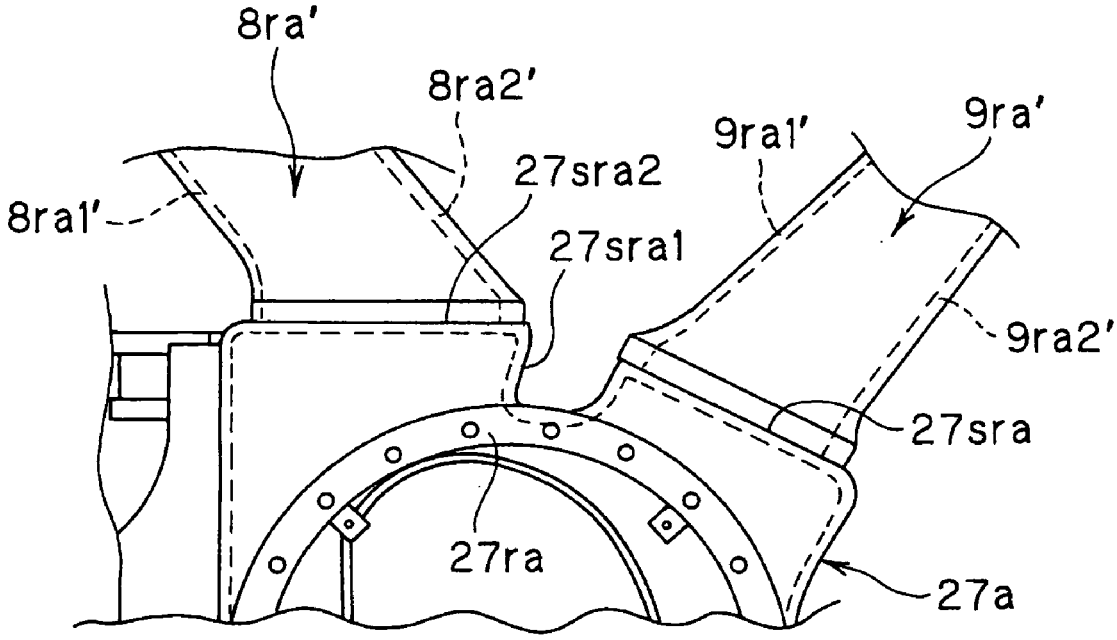
FIG. 8 is a conceptual top view of a modified example of a joining portion between a center frame and a connecting member in the second embodiment according to the present invention.
Figure 9:
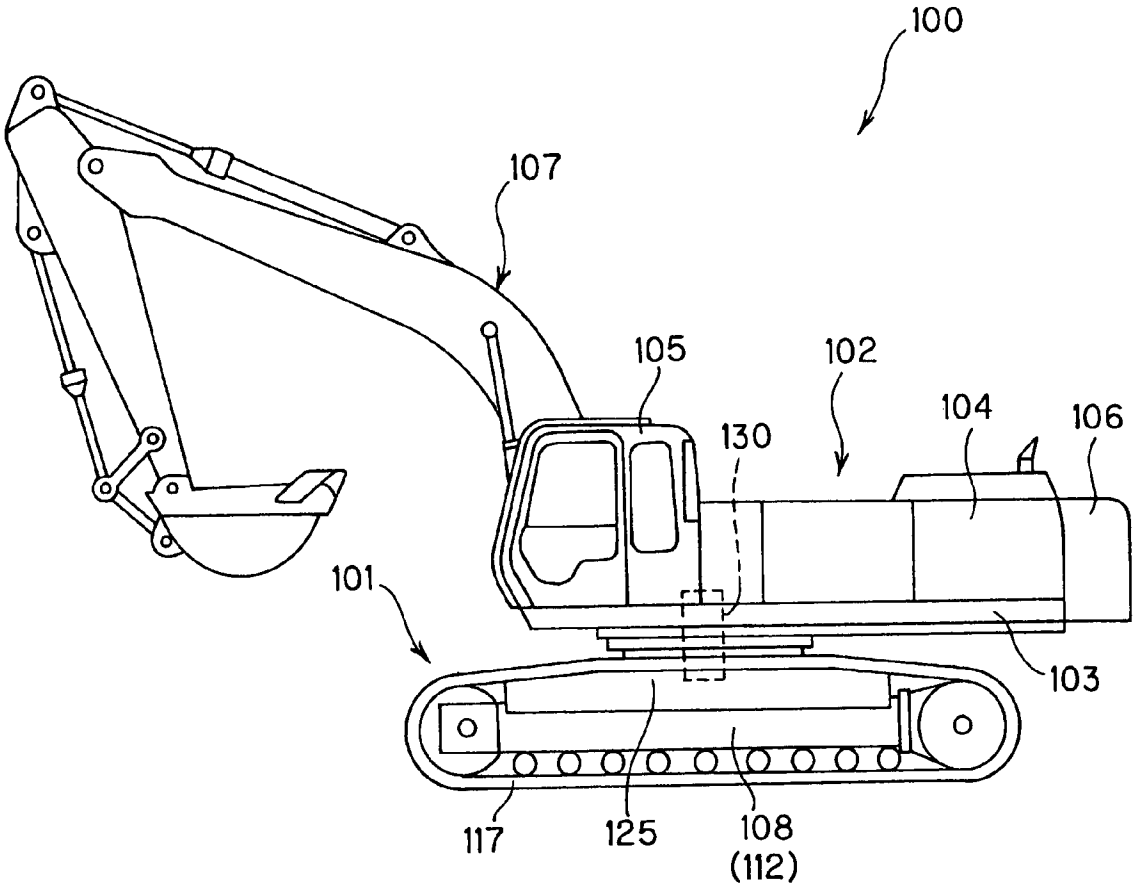
FIG.9 (PRIOR ART)
FIG. 9 is a side view showing a conventional hydraulic shovel.
Figure 10B:
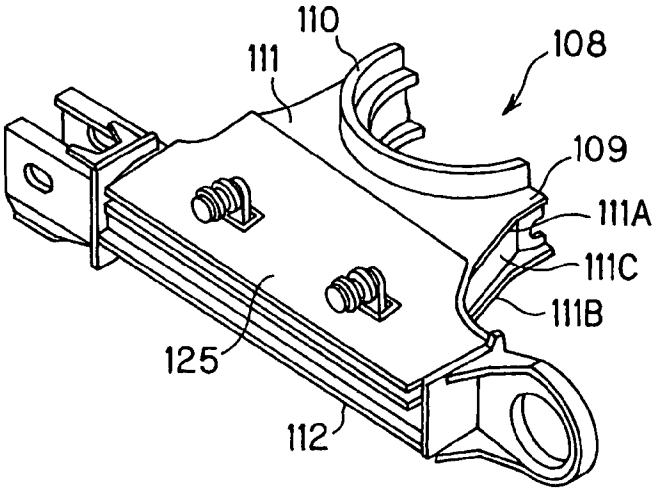
FIG.10B (PRIOR ART)
FIGS. 10A, 10B, and 10C are a plan view, a perspective view, and a sectional view along an I—I line of FIG. 10A showing a truck frame, a mudguard cover, and so on of a conventional hydraulic shovel.
Figure 10C:
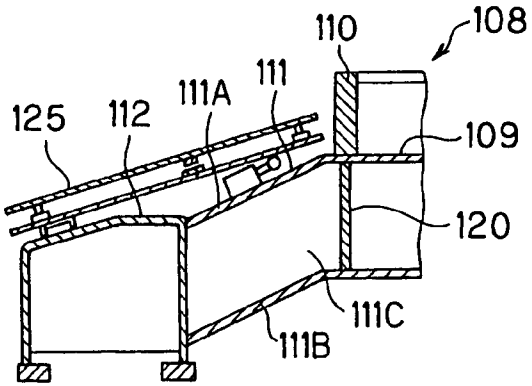
FIG.10C (PRIOR ART)
Figure 10A:
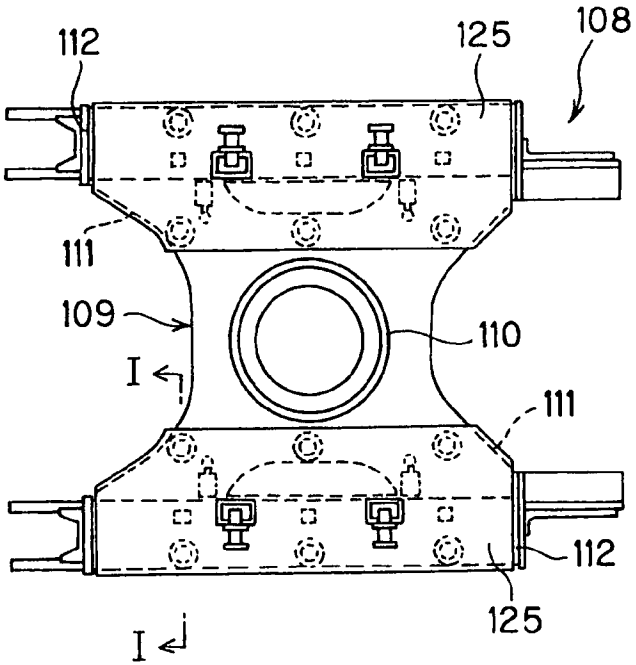
FIG.10A (PRIOR ART)

Next, a modified example of the second embodiment will be described using FIG. 8 (which is a conceptual top view of the vicinity of the joining portion between a center frame 27*a* and connecting members 8*ra*', 9*ra*').

Note that the constitution of the vicinity of the joining portion between the center frame 27*a* and connecting members 8*la*', 9*la*' is identical to the constitution of the vicinity of the joining portion between the center frame 27*a* and the connecting members 8*ra*', 9*ra*', and is symmetrical thereto about the central face of the center frame 27*a* in the direction of width. Accordingly, description will only be provided regarding the constitution of the vicinity of the joining portion between the center frame 27*a* and the connecting members 8*ra*', 9*ra*'.

A right side plate 27*sra* of the center frame 27*a* is formed in a position jutting out from the side portion of an attachment ring 27*ra* when seen from above, and a reinforcing plate portion 27*sra*1 which recedes inward beneath the attachment ring 27*ra* between the locations at which the connecting members 8*ra*', 9*ra*' are joined is formed on the right side plate 27*sra*.

The reinforcing plate portion 27*sra*1 extends inward from the inside of a joining portion 27*sra*2 between the right side plate 27*sra* and the connecting member 8*ra*', passes beneath the attachment ring 27*ra* or the vicinity thereof, and then extends along the line of extension of a front vertical plate 9*ra*1' of the connecting member 9*ra*'.

Here, running loads that are transmitted to the connecting members 8*ra*', 9*ra*' from a truck frame 4*r*' are transferred to the right side plate 27*sra* of the center frame 27*a* via the connecting member 8*ra*' formed from the front vertical plate 8*ra*1', rear vertical plate 8*ra*2', and so on, and the connecting member 9*ra*' formed from the front vertical plate 9*ra*1', rear vertical plate 9*ra*2', and so on.

However, according to the constitution of this modified example, the reinforcing plate portion 27*sra*1 extends inward from the inside of the joining portion 27*sra*2 between the right side plate 27*sra* and the connecting member 8*ra*', and hence a transfer load from the connecting member 8*ra*' can be received along the line of extension of the connecting member 8*ra*', or in other words in the reinforcing plate portion 27*sra*1 which is disposed along the load transmission direction.

Further, since the reinforcing plate portion 27*sra*1 extends along the line of extension of the front vertical plate 9*ra*1' of the connecting member 9*ra*', loads are transferred smoothly to the reinforcing plate portion 27*sra*1 which is disposed along the load transmission direction.

Hence a transfer load from the connecting members 8*ra*', 9*ra*' can be dispersed over the center frame 27*a* without applying any structurally excessive loads thereto.

Thus the reinforcing plate portion 27*sra*1 enables improvements in the load-withstanding strength of the center frame 27*a* not only to loads transmitted to the attachment ring 27*ra*, but also to loads that are transmitted to the center frame 27*a* from the connecting members 8*ra*', 9*ra*'.

It goes without saying that similar effects to those of the second embodiment described above are also achieved in this modified example.

Note that in this modified example, a description was provided in which the reinforcing plate portion 27*sra*1 is formed on the line of extension of the front vertical plate 9*ra*1' of the connecting member 9*ra*', but the reinforcing plate portion 27*sra*1 may be provided on the line of extension of the front vertical plate 8*ra*1' or rear vertical plate 8*ra*2' of the connecting member 8*ra*', or on the line of extension of the rear vertical plate 9*ra*2' of the connecting member 9*ra*'.

Note that in the embodiment described above, an example was provided in which a hydraulic shovel is used as the construction machine, but the construction machine according to the present invention may of course be applied effectively to a construction machine other than a hydraulic shovel having a similar constitution.

For example, the present invention may be applied effectively to a machine other than a hydraulic shovel which has a base carrier constitution, such as a crawler dump, a bulldozer, or an agricultural machine.

What is claimed is:

1. A construction machine comprising a lower traveling body having a frame and an upper slewing body which slews freely about the lower traveling body, the frame of the lower traveling body comprising a hollow center frame having an upper plate, a lower plate, and side plates surrounding sides thereof, the upper plate being formed with an attachment ring on which a slewing bearing of the upper slewing body is mounted; a pair of truck frames disposed on outside of two side portions of the center frame; and connecting members for connecting the center frame to the truck frames, center joining portions of the connecting members being welded to the side plates of the center frame, wherein the center frame comprises the side plates positioned so as to jut out from the attachment ring, and reinforcing ribs which connect the upper plate to the lower plate in an interior of the center frame beneath the attachment ring, and the reinforcing ribs expand from the side plates to the interior of the center frame beneath the attachment ring.

2. The construction machine according to claim 1, wherein the reinforcing ribs have a U-shape when viewed from above the frame, where tops of the U-shape are joined to the side walls.

3. The construction machine according to claim 2, wherein the reinforcing rib is provided on an inside of the center frame and inside of the joining portion of the connecting member, or extending along a line of extension of a vertical plate of the connecting member.

4. The construction machine according to claim 1, wherein the reinforcing rib is provided on an inside of the center frame and inside of the joining portion of the connecting member, or extending along a line of extension of a vertical plate of the connecting member.

5. A construction machine comprising a lower traveling body having a frame and an upper slewing body which slews freely about the lower traveling body, the frame of the lower traveling body comprising a hollow center frame having an upper plate, a lower plate, and side plates surrounding sides thereof, the upper plate being formed with an attachment ring on which a slewing bearing of the upper slewing body is mounted; a pair of truck frames disposed on outside of two side portions of the center frame; and connecting members for connecting the center frame to the truck frames, the center joining portions of the connecting members being welded to the side plates of the center frame, wherein the side plate of the center frame is formed in a position jutting out from the attachment ring, and comprises a reinforcing plate portion which recedes inward below the attachment ring at an intermediate portion of locations at which the center joining portion of the connecting member is joined.

6. The construction machine according to claim 5, wherein the reinforcing plate portion is provided on an inside of the center frame and inside of the joining portion of the connecting member, or extending along a line of extension of a vertical plate of the connecting member.

* * * * *